US005211295A

United States Patent [19]

Dunn

[11] Patent Number: 5,211,295

[45] Date of Patent: May 18, 1993

[54] ROTATABLE PACKAGE DISPLAY RACK WITH CROSS ARMS

[75] Inventor: Henry L. Dunn, Parkton, Md.

[73] Assignee: Dunn Woodworks, Parkton, Md.

[21] Appl. No.: 900,289

[22] Filed: Jun. 18, 1992

[51] Int. Cl.[5] ..... A47F 5/00

[52] U.S. Cl. ..... 211/163; 211/59.1; 211/205

[58] Field of Search ..... 211/163, 59.1, 57.1, 211/58, 78, 205

[56] References Cited

U.S. PATENT DOCUMENTS

| | | | |
|---|---|---|---|
| 69,302 | 10/1867 | Arnold . | |
| D. 239,346 | 3/1976 | Scherzer et al. . | |
| 1,353,670 | 9/1920 | Straith . | |
| 2,247,774 | 7/1941 | Forsyth . | |
| 2,890,801 | 6/1959 | Ladd et al. . | |
| 3,092,258 | 6/1963 | Bleed | 211/163 |
| 3,502,226 | 3/1970 | Marschak | 211/163 |
| 3,844,230 | 10/1974 | Hudson . | |
| 3,865,249 | 2/1975 | Herzog | 211/163 |
| 3,939,985 | 2/1976 | Hochmann . | |
| 4,026,508 | 5/1977 | Ziegler . | |
| 4,114,763 | 9/1978 | Hochman . | |
| 4,361,241 | 11/1982 | Stoddard . | |
| 4,482,062 | 11/1984 | Huntsberry | 211/163 X |
| 5,038,946 | 8/1991 | Tenser et al. | 211/59.1 X |

*Primary Examiner*—Robert W. Gibson, Jr.
*Attorney, Agent, or Firm*—Mason, Fenwick & Lawrence

[57] ABSTRACT

A rotatable package display rack comprises a post made of four vertically extending boards, two of the boards being spaced and parallel boards, and the other two boards being spaced and parallel, and perpendicular to the first two boards. An edge of one board engages the side of another board, and a hollow provided by faces of the vertical boards receives and journals a shaft extending upwardly from feet which support the post. The boards are notched, to receive cross arms, the cross arms supporting hangers from which packaged products may be suspended. Each cross arm is in engaging relationship with notches in two of the boards of the post, and engages the faces of the other two boards of the post.

14 Claims, 2 Drawing Sheets

ROTATABLE PACKAGE DISPLAY RACK WITH CROSS ARMS

BACKGROUND OF THE INVENTION

The present invention relates to a rotatable package display rack, and more particularly to such a rack having cross arms extending through a supporting post.

Many products are marketed by placing them in packages, such as transparent bags closed at their tops. This type of merchandise packaging, and packaging of merchandise on cards, has led to the development of display racks of various kinds. A number of such display racks include substantially horizontally extending hangers, in the form of metal wires. Examples of such racks with hangers are provided by Hochman U.S. Pat. No. 3,939,985, Ziegler U.S. Pat. No. 4,026,508, and Hochman U.S. Pat. No. 4,114,763.

Supports or racks for various purposes have been provided which comprise a post, cross arms and feet. Ladd et al U.S. Pat. No. 2,809,801 provides such a support, for holding apertured articles on cross arms of the rack in abutting relationship. The cross arms are supported by and extend from a block which is secured to the post. This is an expensive construction, requiring that a block be produced and machined. Forsyth U.S. Pat. No. 2,247,774 provides a post with interpenetrating cross arms at the top for supporting clothing, and extending through slots in the post, and a similar construction to provide the feet for the post. This construction permits only a single pair of cross arms to be secured to the post.

Stoddard U.S. Pat. No. 4,361,241 provides a hanger support comprising a post formed by four vertically extending and spaced apart rods, the rods at their lower ends having horizontal extensions to provide feet: the rods are welded together, and consequently, this construction is one which may not be shipped in disassembled fashion, and then readily assembled.

Straith U.S. Pat. No. 1,353,670 provides a clothes drier construction comprising a post having arms secured to it. The post is of Maltese cross cross-sectional shape, and at its bottom has a hole into which a bolt is threaded, to secure a plate having depending feet to the post. At its top, the post has slots, arms being pivotally secured to the post and passing through the slots. In this construction, the arms are supported in horizontal position by vertically extending posts pivotally attached to their outer ends. Arnold U.S. Pat. No. 69,302 is generally similar, but the post is of square transverse cross-section, and there are no supporting feet, the post being hung from a ring at the top.

Scherzer et al U.S. Pat. No. 239,346 discloses a rotatable book rack, the construction apparently comprising four vertically extending boards provided in two pairs, the boards of each pair being in spaced, parallel relationship and in perpendicular relationship to the boards of the other pair. Each board has an edge which is in abutting relationship with the side of a board to which it is perpendicular. These vertical boards support a number of horizontal shelves which are vertically spaced. The boards forming the central column apparently extend either from one shelf to the next, making for an unduly large number of parts, or extend through openings in the shelves, requiring an expensive construction for making the required shaped openings in the shelves.

SUMMARY OF THE INVENTION

The present invention is directed to a rotatable package display rack comprising a post, a plurality of cross arms which penetrate the post, and supporting feet. The post is provided by two sets of parallel spaced and vertically extending boards, with the boards of one set being perpendicular to the boards of the other set, and an edge of one board engaging the face of a board to which it is perpendicular. Each cross arm extends through the post, and is preferably of rectangular cross-section, opposite vertical faces of the cross arms engaging surfaces of the boards of the post. The cross arms are interpenetrating, to provide compactness and strength. Extending from the cross arms are hangers, each set of hangers extending substantially parallel to an adjacent cross arm. The post is supported by feet to which is connected a vertically extending shaft of a size to extend into the hollow of the post to thereby permit rotation of the post.

The package display rack may be manufactured and shipped with the parts forming the post, cross arms and fee disassembled, thereby saving shipping costs. Whether shipped assembled or disassembled, accurate assembly is facilitated through the use of notches in the cross arms to provide interpenetrating assembly of them, and notches are provided in the boards of the post to accommodate and securely hold the cross arms. The accurate assembly of the posts provided by the present construction enables the journalling of the post on the shaft, for rotation, so that a customer may be able to rotate the post and cross arms to view a large number of packages carried by the rods/hangers which extend from the cross arms.

Among of the objects of the present invention are to provide a rotatable package display rack which will enable the displaying of a large number of merchandise packages in minimal space, which may be shipped disassembled and then readily assembled, and which may be assembled with sufficient fixtures to provide a journalling engagement between the post and the shaft supported by the feet. Other objects of the present invention include the provision of a rotatable package display rack which is of strong construction to withstand forces on the arms to cause rotation of the post and cross arms.

Other objects and many of the attendant advantages of the present invention will be readily understood from the following drawings, as well as the specification and claims appended hereto.

DESCRIPTION OF THE PREFERRED EMBODIMENT

Figure 1:
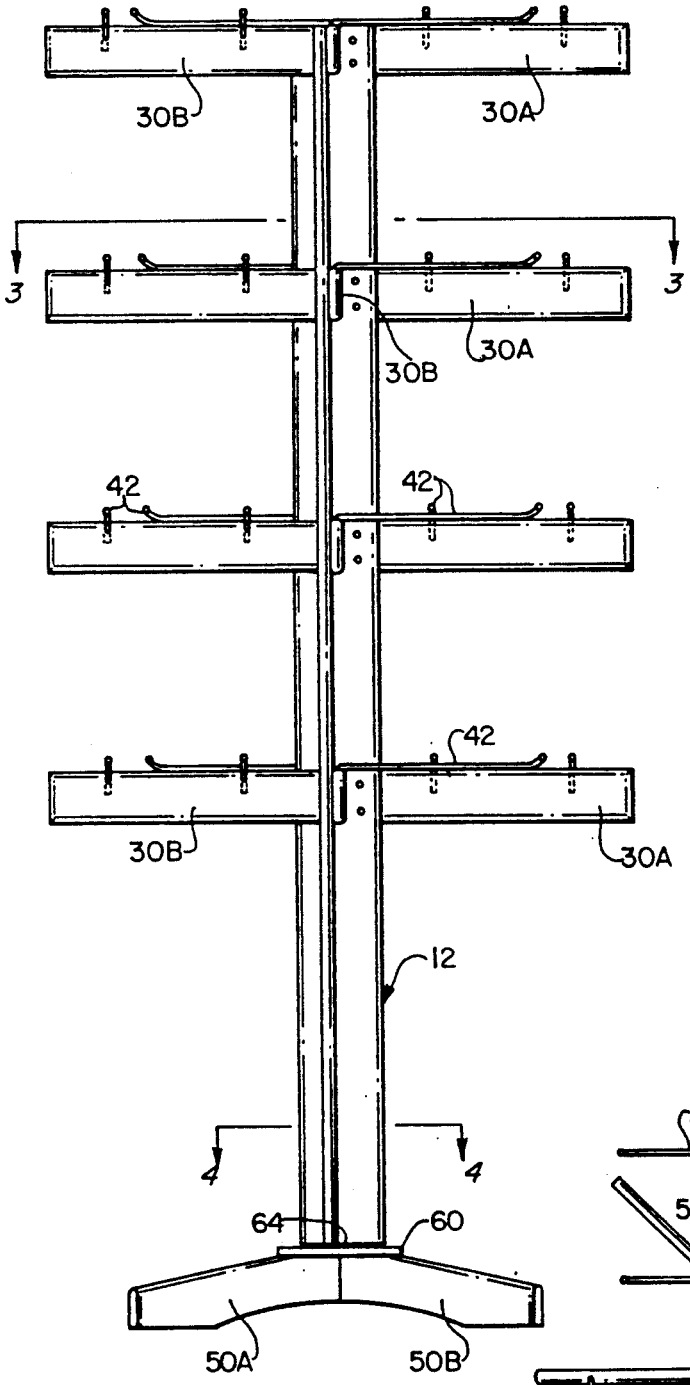
FIG. 1 is an elevational view of a rotatable package display rack in accordance with the present invention.
Figure 2:
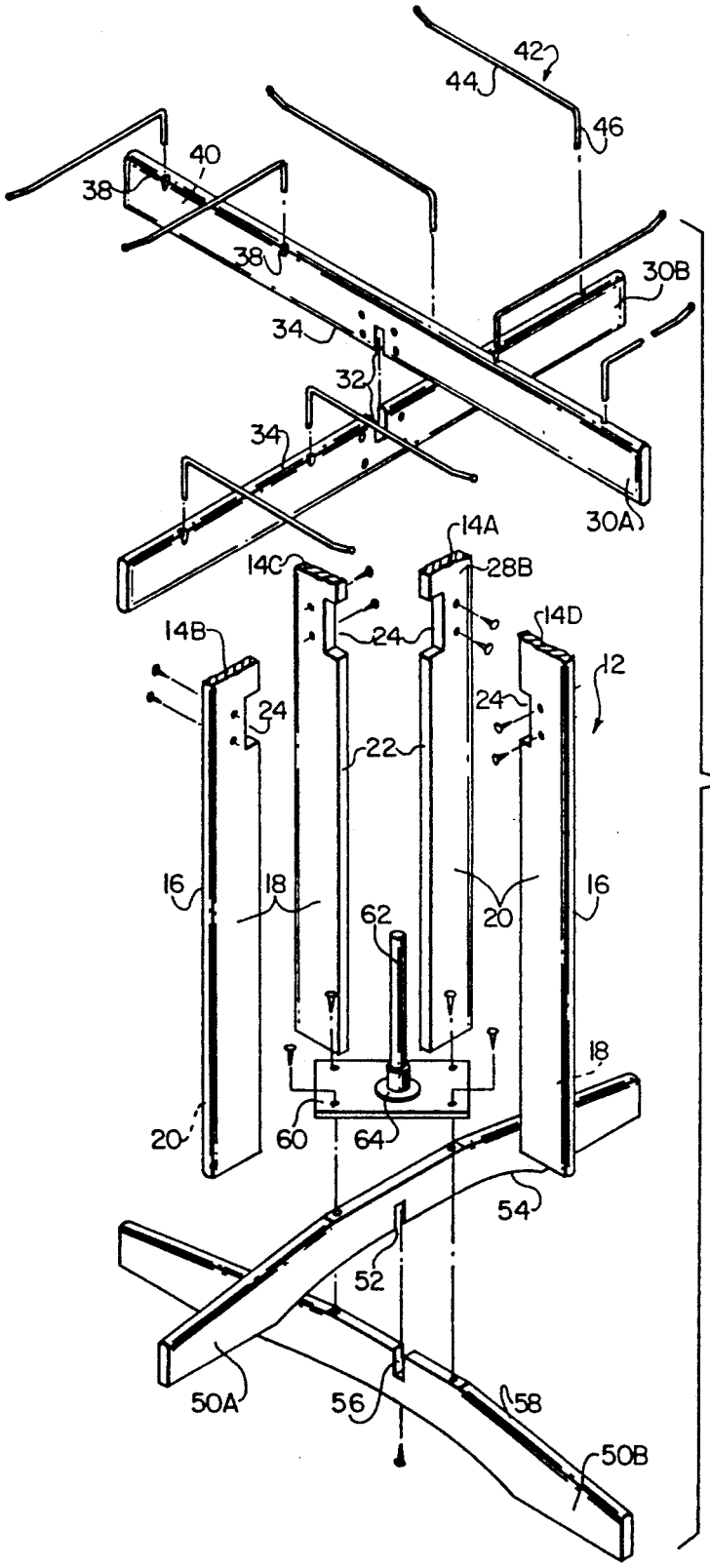
FIG. 2 is an exploded view with parts removed, of the rotatable package display rack of FIG. 1.

Referring now the drawings, wherein like or corresponding reference numerals are used for like or corresponding parts throughout the several views, there is shown in FIG. 1 a rotatable package display rack 10 comprising a post 12, cross arms 30A, 30B, and feet 50A, 50B. Referring to FIG. 2, the post 12 may be seen to comprise four identical vertically extending boards 14A, 14B, 14C and 14D, each board 14 being of generally rectangular cross-section and having a continuous edge 16, a pair of parallel faces 18 and 20, and an edge 22 in which there is provided a series of spaced notches 24, only one of which is shown in FIG. 2 in each of the boards 14. The notches 24 receive in engaging relationship the cross arms 30A and 30B. The notches 24 are made in the boards 14A–14D at the same level.

The cross arms 30A and 30B are of substantially identical construction, being of generally rectangular cross-section, and having notches 32 extending approximately half-way therethrough from an edge 34. By this construction, the cross arms 30A and 30B may be assembled in interpenetrating manner, so that their top edges and bottom edges are respectively coplanar. Each of the cross arms 30A and 30B is provided with notches 38 which are connected with holes 40 for the reception of hangers 42 which are metal rods, having a horizontal portion 44 and a vertical portion 46. The vertical portion 46 extends into the notches 38 and holes 40, the portions 44 extending horizontally as shown in FIG. 1. The portion 44 of the hanger 42 supports merchandise or merchandise packages in known manner.

Figure 3:
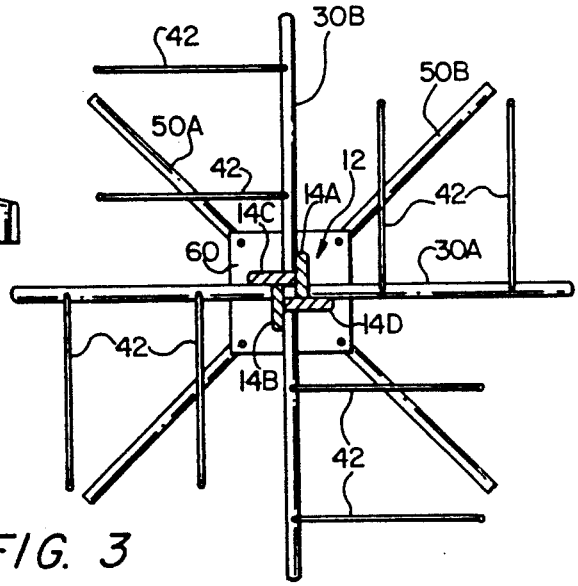
FIG. 3 is a cross-sectional view taken on the line 3—3 of FIG. 1.

While there has been shown in FIG. 2 only a single set of cross arms 30A and 30B, as will be appreciated from FIG. 1, as many such sets of cross arms as desired may be provided, all of the cross arms having the same relationship with the post 12 as is illustrated in FIGS. 2 and 3.

In FIG. 3, there is shown the interrelated structure of the post 12 and the cross arms 30A and 30B. More particularly, the spacing between the boards 14C and 14D is substantially equal to the width of the cross arm 30A, so that the sides of cross arm 30A are in substantial surface engagement with the a face of each of the boards 14C and 14D, to provide strength and stability. The cross arm 30A passes through notches 24 in the boards 14A and 14B, which are of size and shape to engagingly receive the cross arms, to thereby provide strength to the rotatable post 12 and cross arms 30A, 30B.

Also, in FIG. 3 there may be seen the hangers 42 extending from the cross arms 30A and 30B, thereby providing for the display of a substantial quantity of packaged merchandise, or articles supported directly on the hangers.

The post 12 is supported by feet 50A and 50B as shown in FIG. 1. Referring to FIG. 2, the foot 50A will be seen to have a notch 52 in the lower edge 54 thereof, extending approximately half-way through the depth thereof, and the foot 50B has a similar notch 56 extending downwardly from the upper edge 58 thereof, so that upon assembly, the feet 50A and 50B will be interpenetrating with their top and bottom edges in the region of the notches 52 and 56 being respectively coplanar. A metal plate 60 has secured to it, as by welding, a shaft 62. One or more anti-friction washers 64 are provided on shaft 62, the lower surface of which engages the plate 60 and the upper surface of which is engaged by the lower ends of the boards 14A–14D forming hollow post 12. The plate 60 is securely fastened to the feet 50A and 50B by screw threaded fasteners.

Figure 4:
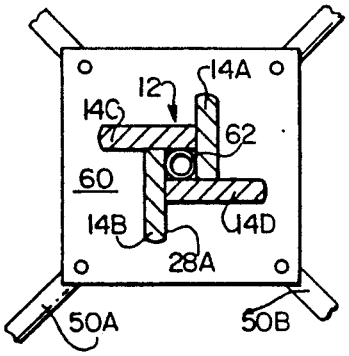
FIG. 4 is a cross-sectional view taken on the line 4—4 of FIG. 1, with parts broken away.

As may be seen in FIG. 4, the post 12 has a hollow therein, formed by surfaces 28A of each of the boards 14A–14D. This hollow will be seen to be of square cross-section, and the shaft 62 is journalled in it. As may be seen from FIG. 2, the shaft 58 extends a substantial distance upwardly into the hollow of the post 12, in order to provide a substantial journalling surface interengagement.

As will be appreciated, and as indicated the drawings, screws or similar fasteners are used to secure the cross arms 30A and 30B to the boards 14A–14D forming the post 12, passing through and into accurately positioned holes in the boards 14 and the cross arms 30A, 30B, thereby providing for secure assembly of the parts, and ensuring the assembly of the boards 14A–14D in a manner so that there will result a hollow providing journalling surfaces spaced at the correct distance There has been provided a rotatable package display rack which may be shipped in disassembled condition and which may be assembled with readily available tools to provide a strong construction and one which provides for relative precise positioning of surfaces of the boards forming the post to provide for journalling engagement with the shaft.

The construction of the rotatable package display rack is extremely strong, so as to enable it to withstand the forces imparted to it by customers turning the rack to view all of the packages supported by the hangers. Thus, each of the cross arms is engaged and held by all four of the boards forming the post and screws, to provide strength and rigidity.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

What is claimed is:

1. A rotatable package display rack comprising:

a post extending substantially vertically and comprising four boards, two of said boards being in spaced parallel relation and two of said boards being in spaced parallel relation and perpendicular to said first two boards, each said board having an edge engaging a surface of an adjacent board, at least one cross arm extending transversely through said post and having spaced vertical surfaces, said vertical surfaces of said cross arm respectively engaging a surface of a first and a second board of said post, and means for supporting said post at the lower end thereof.

2. The rotatable package display rack of claim 1, and further comprising a second cross arm extending transversely through said post and being perpendicular to said first cross arm.

3. The rotatable package display rack of claim 2, wherein said first and second cross arms are interpenetrating.

4. The rotatable package display rack of claim 1, said cross arms having a generally rectangular cross-section, two of said boards of said post being transverse to said cross arm and each having a notch therein engagingly receiving said cross arm.

5. The rotatable package display rack of claim 4, and further comprising a second cross arm perpendicular to said first mentioned cross arm, the other two of said boards of said post being transverse to said second cross arm and having notches therein engagingly receiving said second cross arm.

6. The rotatable package display rack of claim 5, wherein said first and second cross arms are interpenetrating.

7. The rotatable package display rack of claim 1, said supporting means comprising means for supporting said post for rotation on the axis thereof.

8. The rotatable package display rack of claim 1, said means for supporting said post comprising:

horizontally extending feet, a vertically extending shaft, means for securing said shaft to said feet, said shaft extending into said post and being in journalling engagement with the boards thereof.

9. The rotatable package display rack of claim 8, wherein said means for securing said shaft to said feet comprises a plate secured to an end of said shaft, and fasteners securing said plate to each of said feet.

10. The rotatable package display rack of claim 1, and further comprising at least one substantially horizontal hanger extending from said cross arm for supporting packages thereon.

11. A rotatable package display rack comprising:

a post comprising four substantially vertically extending boards, each of rectangular horizontal cross-section, a first two of said boards being in spaced, parallel relation, and a second two of said boards being in spaced, parallel relation and in planes perpendicular to said first two boards, each said board having a vertically extending edge thereof in engagement with a surface of an adjacent board transverse thereto, thereby providing a longitudinally extending hollow within said post of substantially square cross-section, a pair of cross arms in interpenetrating relationship intermediate the ends thereof, the interengaging portions of said cross arms being within said hollow of said post, said cross arms each having a substantially vertical rectangular cross-section, and each said cross arm having a pair of spaced, parallel surfaces extending in vertical planes, each surface of each cross arm engaging the vertically extending surface of the board of a post, and means for supporting said post at the lower end thereof.

12. The rotatable package display rack of claim 11, and further comprising at least one substantially horizontal rod extending from a said cross arm for supporting packages thereon.

13. The rotatable package display rack of claim 11, said supporting means comprising means for supporting said post for rotation of the axis thereof.

14. The rotatable package display rack of claim 11, wherein said means for supporting said post comprises:

a plurality of feet, a vertically extending shaft, means for securing said shaft to said feet, said shaft extending into said post and being in journalling engagement with the boards thereof.

* * * * *